US012296245B1

(12) United States Patent
Compean

(10) Patent No.: US 12,296,245 B1
(45) Date of Patent: May 13, 2025

(54) SWING TRAINING AID AND METHODS OF USING SAME

(71) Applicant: Christian Compean, San Antonio, TX (US)

(72) Inventor: Christian Compean, San Antonio, TX (US)

( * ) Notice: Subject to any disclaimer, the term of this patent is extended or adjusted under 35 U.S.C. 154(b) by 0 days.

(21) Appl. No.: 17/650,303

(22) Filed: Feb. 8, 2022

Related U.S. Application Data

(60) Provisional application No. 63/146,887, filed on Feb. 8, 2021.

(51) Int. Cl.

| | |
|---|---|
| ***A63B 69/36*** | (2006.01) |
| ***A63B 21/04*** | (2006.01) |
| ***A63B 21/055*** | (2006.01) |
| *A63B 21/00* | (2006.01) |

(52) U.S. Cl.
CPC ..... *A63B 69/3608* (2013.01); *A63B 21/0442* (2013.01); *A63B 21/0552* (2013.01); *A63B 21/4009* (2015.10); *A63B 2210/50* (2013.01)

(58) Field of Classification Search
CPC ..... A63B 69/3608; A63B 21/0442; A63B 21/0552; A63B 21/4009; A63B 2210/50
USPC ..... 473/215, 216, 277
See application file for complete search history.

(56) References Cited

U.S. PATENT DOCUMENTS

| | | | | |
|---|---|---|---|---|
| 2,893,736 A * | 7/1959 | Tesi | A63B 69/0059 473/216 |
| 5,924,933 A * | 7/1999 | Pacheco | A63B 69/3608 473/277 |
| 8,512,171 B1 * | 8/2013 | Minotti | A63B 69/0057 473/422 |
| 8,784,230 B1 * | 7/2014 | Mitchell | A63B 69/0057 473/271 |
| 9,011,156 B2 * | 4/2015 | Hallmark | A63B 21/4025 434/247 |

* cited by examiner

*Primary Examiner* — Nini F Legesse
(74) *Attorney, Agent, or Firm* — William H. Quirk; Cassidi D. Benales; Rosenthal Pauerstein Sandoloski Agather, LLP

(57) ABSTRACT

A swing training aid with a foldable platform that applies two-way resistance for the purposes of swing training. With the swing training aid in its upright position, an athlete dons the bi-directional belt of the swing training aid and takes hold of a coil indicator strap of the swing training aid. At this point, the athlete can utilize the feedback given by the swing training aid to initiate training with the goal of improving rotational velocity. A stepwise method of utilization of the swing training aid facilitates progress for athletes of various skill levels.

20 Claims, 14 Drawing Sheets

Coil indicator with assisted hip rotation

Hitting with assisted hip rotation

Assisted hip rotation

Assisted hip rotation latissimus stretch

Resisted hip rotation

Coil indicator

Coil indicator with assisted hip rotation

Coil indicator with resisted hip rotation

Resisted hip rotation

Assisted hip rotation

SWING TRAINING AID AND METHODS OF USING SAME

CROSS-REFERENCE TO RELATED APPLICATIONS

This application claims the benefit of the filing date of U.S. Provisional Application Ser. No. 63/146,887, filed on Feb. 8, 2021, entitled "SWING TRAINING AID AND METHODS OF USING SAME", as well as the entire disclosure of which is hereby incorporated by reference into the present disclosure.

BACKGROUND

1. Field

The present disclosure relates to athletic training aids, as well as to related aspects of their use. More particularly, the disclosure is most directly related to rotational swing training aids.

2. Description of Related Art

Currently available training aids and methods focus on a single plane of motion at one time. The force applied is often anchored only to the lower extremities or upper extremities independently. These training aids and methods are only useful for training in a single plane of motion. This fails to address the necessity of athletes moving in two planes simultaneously to maximize rotational velocity.

Several training aids attach at the hip via a belt. These belts tend to slide and alter the desired force vector imparted on the athlete. Many of these belts are unidirectional and are donned in one orientation then reversed if the contralateral side is to be trained.

SUMMARY OF THE INVENTION

The swing training aid provides biofeedback via two force resistances for the purpose of swing training. The Swing training aid includes a foldable platform with multiple anchor points. In the folded orientation, the platform is portable. Unfolding the platform produces a standing section and an upright section that is near the height of the trail hip. The athlete then steps onto the swing training aid. The belt is then snuggly adjusted around the level of anterior inferior iliac spine of the pelvis with one anchor point located over the sacrum and the other in midline on the anterior surface of the pelvis. The Coil Indicator is then adjusted to place the anchor point of the Coil Indicator Strap at the athlete's desired ball position.

The swing training aid belt is bi-directional with two anchor points. The interior of the belt is lined with a nonslip surface. The posterior anchor point remains in the center of the spine over the sacrum, and the anterior anchor point remains over the traditional belt buckle area. If training on the contralateral side is desired, the belt can remain in situ, and training can be continued on the contralateral side by simply changing the anchor point. The lining on the inside of the belt prevents slipping and ensures the maintenance of the appropriate force vector while training, allowing hands free operation to improve the efficiency of training.

As part of the proposed method of use, the athlete can first improve the flexibility and range of motion of the upper quarters by propping a swing implement (golf club or other) on the shelf created by hinge at support arm and a support plate and producing lower trunk rotation while the upper extremities remain fixed.

To improve the flexibility of the lower extremities with overpressure assistance from the swing training aid resistance band, the resistance band is anchored on the anterior aspect of the belt. The resistance band is then wrapped around the lead hip and across the posterior aspect of the waistline prior to anchoring on the upright. The foot is then fixed by the golf tees inserted in the lead foot positioning holes on the anterior aspect of the standing surface. The foot can be offset in various degrees of rotation (i.e., −15 degrees, −30 degrees) to further emphasize the stretch on the hip. To improve the flexibility of the lower extremities and the upper extremities, both above-listed strategies can be implemented simultaneously. This would further improve the degrees of separation between the upper extremities and lower extremities at the transition phase of the swing.

To assist the transition sequence of the swing, the resistance band of the swing training aid is anchored on the anterior anchor point of the belt, wrapped around the lead hip, and run across the posterior aspect of the waistline prior to being anchored on the upright. The athlete then takes hold of the strap from the Coil Indicator and assumes their normal address position. The strap of the Coil Indicator should have enough slack in it so that the Coil Indicator flexes minimally when the lead arm is parallel to the ground in the back swing. At this point, the athlete takes their upper extremities to the point where the lead arm is parallel to the ground in the back swing and holds that position. The Coil Indicator will flex slightly. The athlete will attempt to maintain the position of the upper extremities utilizing the visual cues from the Coil Indicator. While maintaining this position, the lower extremities are rotated towards the target with assistance from the swing training aid.

To actively train the transition sequence, the resistance band of the sequence is anchored on the posterior anchor point of the belt, wrapped around the lead hip, and run across the anterior aspect of the waistline prior to being anchored on the upright. The athlete then takes hold of the strap from the Coil Indicator and assumes their normal address position. At this point, the athlete takes their upper extremities to the point where the lead arm is parallel to the ground in the back swing and holds that position. The Coil Indicator will flex slightly. The athlete will attempt to maintain the position of the flexed Coil Indicator while initiating rotation of the lower extremities against the resistance provided by the swing training aid resistance strap.

The swing training aid can then be used to improve rotational velocity while practicing hitting a ball. The swing training aid can facilitate this in two ways. To assist the hips in rotating towards the target and improve the athlete's perception of hip rotation, the resistance band is anchored on the anterior anchor point of the belt, wrapped around the lead hip, and run across the posterior aspect of the waist. The resistance band is then anchored to the upright. The athlete can then practice hitting a ball as the belt assists the hips in turning towards the target.

The swing training aid can then be used to train the athlete's strength/timing in rotating the hips toward the target. To achieve this, the resistance band is anchored on the posterior anchor point of the belt, wrapped around the lead hip, and run across the anterior aspect of the waistline. The resistance band is then anchored to the upright. The athlete can then practice hitting ball against the resistance of the Swing training aid to improve the strength/timing of hip rotation towards the target.

Following this method, the athlete then steps off the swing training aid and incorporates the cues provided by the swing training aid into their swing. This will facilitate improved understanding of the proper kinematics to increase the rotation velocity of the swing.

BRIEF DESCRIPTIONS OF THE DRAWINGS

DETAILED DESCRIPTIONS OF PREFERRED EMBODIMENTS

The following descriptions relate to presently preferred embodiments and are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more.

PREFERRED EMBODIMENTS

The following descriptions relate principally to preferred embodiments while a few alternative embodiments may also be referenced on occasion, although it should be understood that many other alternative embodiments would also fall within the scope of the invention. It should be appreciated by those of ordinary skill in the art that the techniques disclosed in these examples are thought to represent techniques that function well in the practice of various embodiments, and thus can be considered to constitute preferred modes for their practice. However, in light of the present disclosure, those of ordinary skill in the art should also appreciate that many changes can be made relative to the disclosed embodiments while still obtaining a comparable function or result without departing from the spirit and scope of the invention.

Figure 1A:
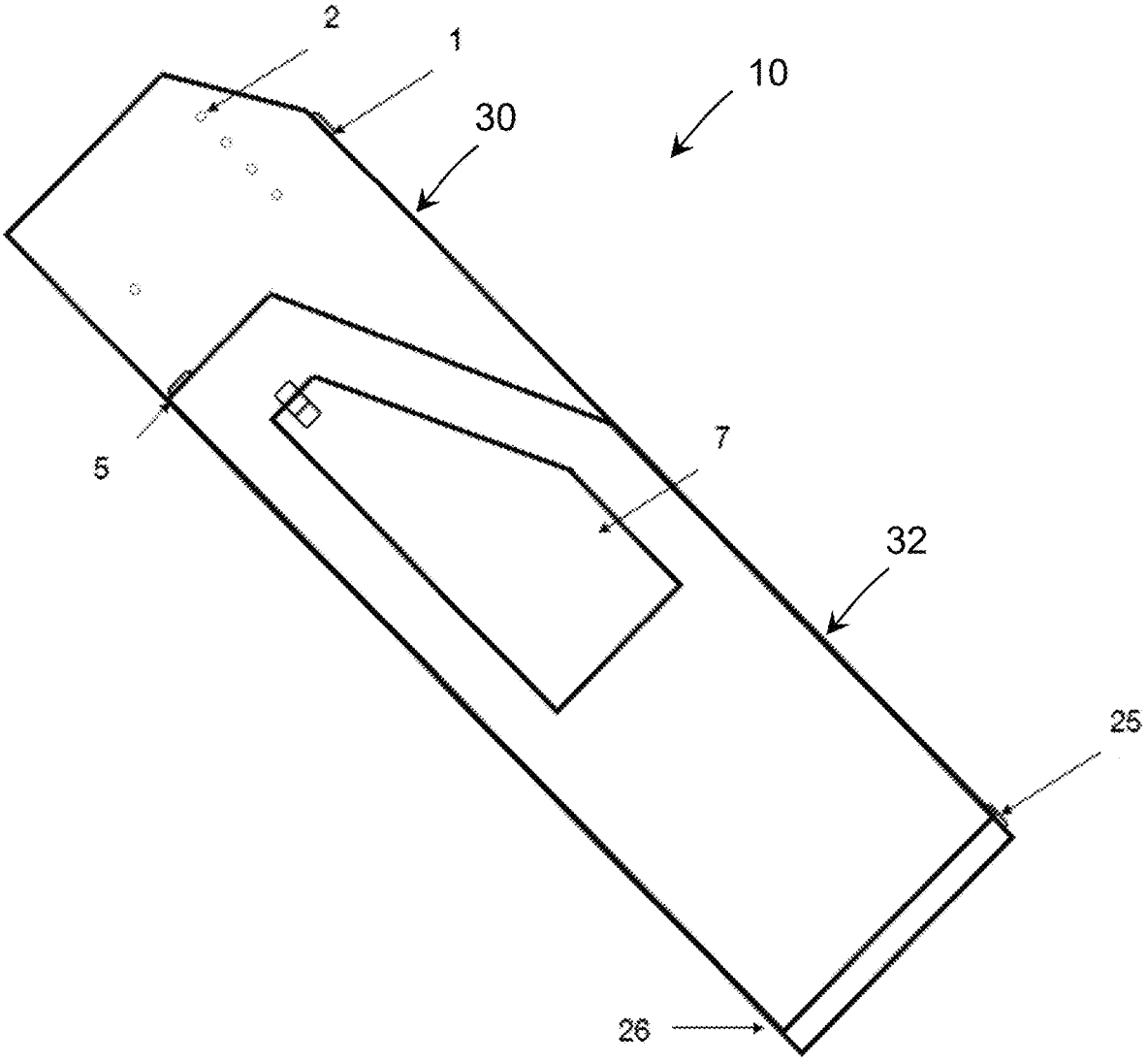
FIG. 1A is a top view of the swing training aid in its folded orientation.
Figure 4B:
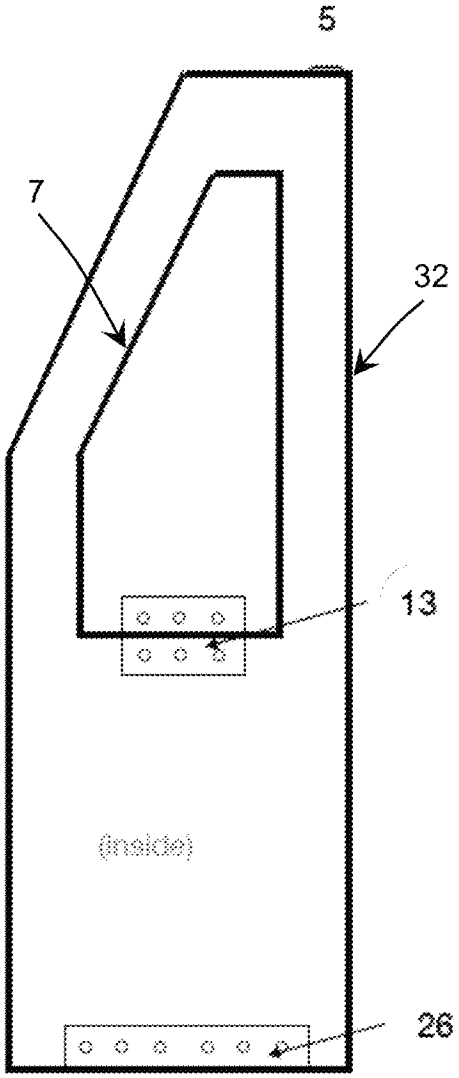
FIG. 4A is a plan view of the outside of the support arm (upright portion) and FIG. 4B is a plan view of the inside of the support arm (upright portion) of the swing training aid.
Figure 4A:
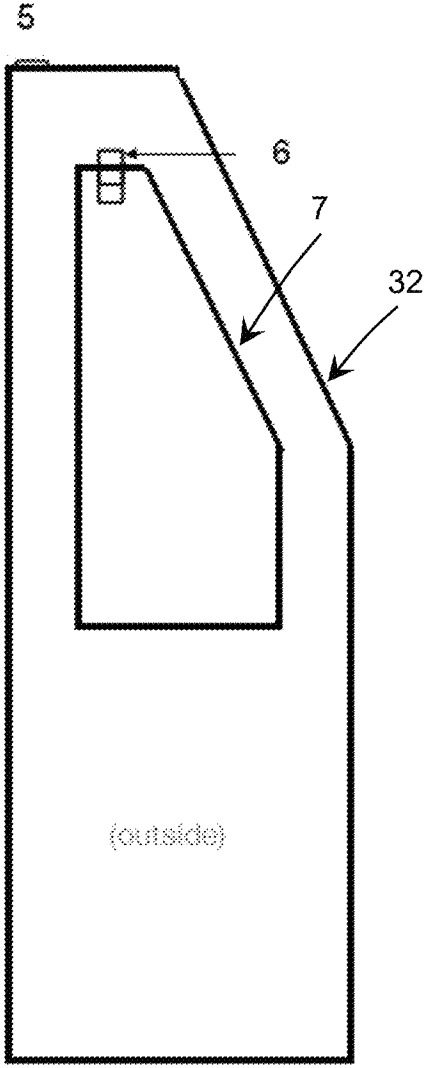

FIG. 1A is a visual representation of the swing training aid (10) in its folded portable orientation. In its folded orientation (also referred to herein as the closed position), support arm (32) of the swing training aid (10) sits on top of base (30) joined by a hinge (26) at the base such that the inside surface of support arm (32) contacts the top surface of base (30). At the top end of base (30) there is an anchor point (1). At the top end of base 30 there are also four ports (2) for golf tees to help set the lead foot at various degrees of external rotation (i.e., −15 degrees-30 degrees of hip external rotation). At the top end of support arm (32) there is another anchor point (5) (as illustrated in FIGS. 4A & 4B) that is used to anchor the resistance strap (24) (shown in FIG. 2) via the clip (23) at the end of the resistance strap (24). There is a locking mechanism (6) (as illustrated in FIG. 4A) at the top of support plate (7) to help secure support plate (7) to support arm (32) when folded. This locking mechanism (6) also helps secure support plate (7) to base 30 when the swing training aid is in its upright position.

Figure 1B:
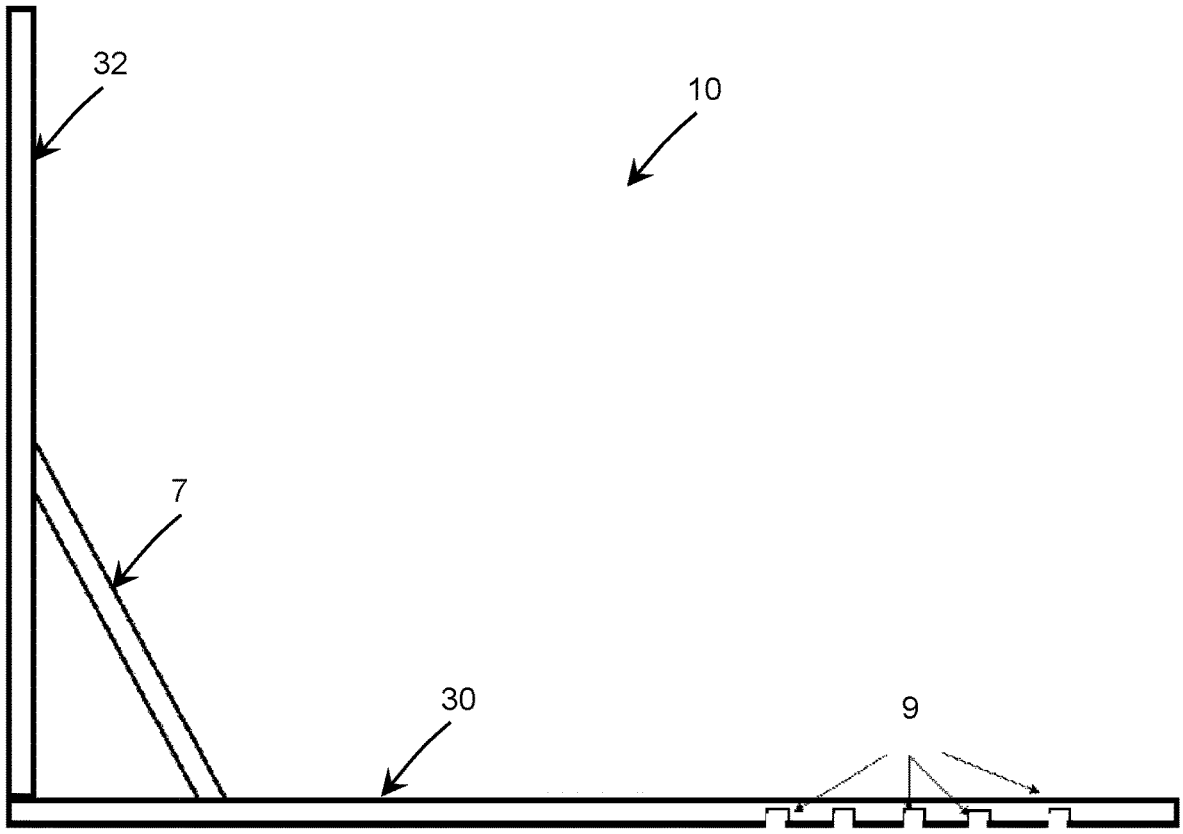
FIG. 1B is a side profile view when the swing training aid is unfolded.

When set up in its upright position, as illustrated in FIG. 1B, (also referred to herein as the open position) support arm (32) is upright at substantially a 90-degree angle to base (30) with support plate (7) dropping down into slot (12) (shown in FIG. 3B) on base (30), making a right triangle and adding structural stability. The hinge (26) at the base of base (30) and support arm (32) further helps to maintain the 90-degree angle of the swing training aid (10) when in the upright position. At an end of base 30 there is an additional anchor point (25). In this position, as discussed in greater detail below, a user is configured to use swing training aid (10) by placing the bottom surface base (30) on the ground and standing on the top surface of base (30) with both feet.

Figure 2:
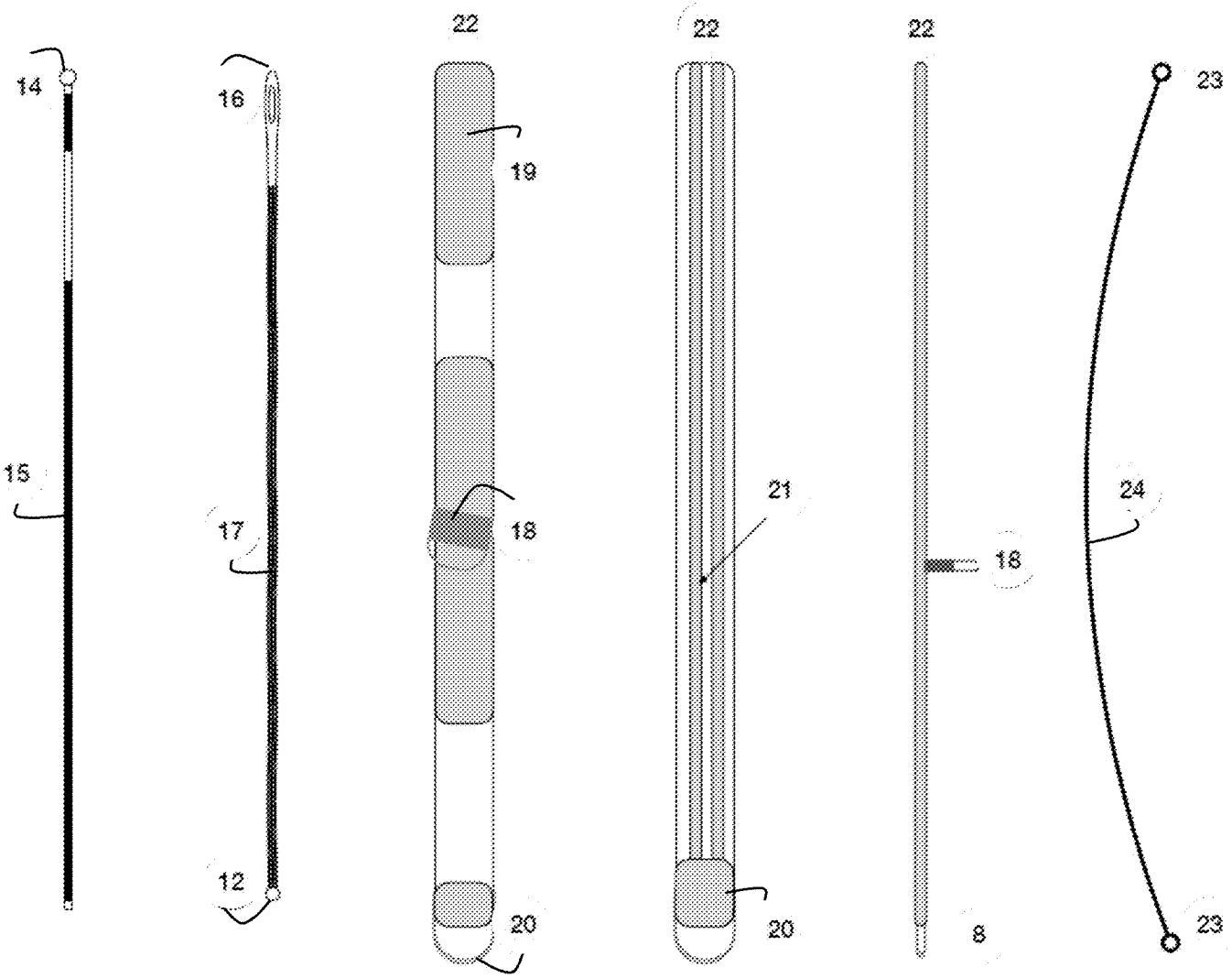
FIG. 2 is a view of the Coil Indicator rod and strap; the belt inside, outside, and profile view; and resistance cord.

FIG. 2 illustrates the individual components of the swing training aid. The Coil Indicator (15) is shown with an anchor point (14) at the top for the Coil Indicator (15). At the top of the Coil Indicator Strap (17) is the swing implement receiver loop (16). The swing implement may be a golf club, baseball bat, or other like device that an athlete swings as part of participating in a particular sport. The bidirectional belt (22) has a bidirectional anchor point (18) in the center, a D ring belt buckle (20) on one end with the hook, and a loop fastening end (19) on the opposite side. The inside of the belt (22) is lined with nonslip strips (21) to ensure good positioning at the athlete's waist when properly donned. From a profile view of the belt (22), the height of the bidirectional anchor point (18) can be observed. The resistance strap (24) has anchor points at each end (23).

Figure 3B:
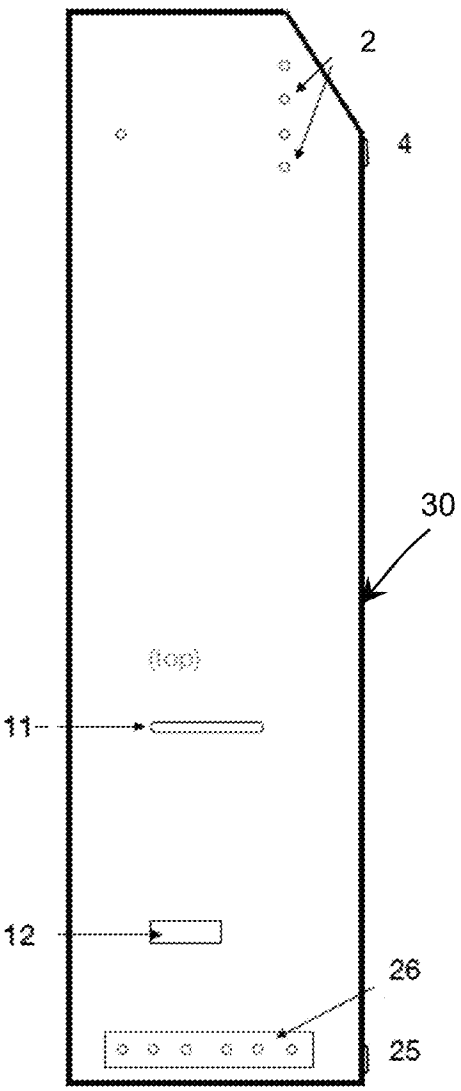
FIG. 3A is a plan view of the bottom side of the base standing platform and FIG. 3B is a plan view of the top side of the base standing platform.
Figure 3A:
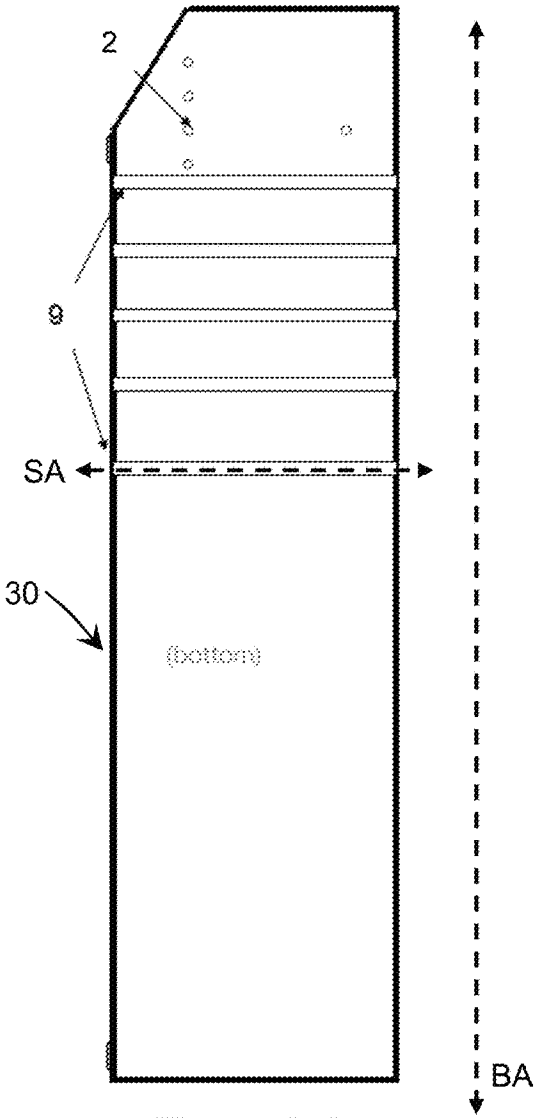

FIG. 3A illustrates the bottom surface of base (30) and shows the slots (9) for the Coil Indicator rod (15) portion and the bottom of the ports (2) for foot placement. Each of the slots (9) are formed such that an associated slot length axis (SA) of each slot is substantially perpendicular with base length axis (BA) of base (30). The top surface of base 30, as illustrated in FIG. 3B, shows the location of slot (12) for support plate (7) and slot (11) that serves a resting place for the hinge (13) on the inside of base 30 that joins base 30 to support plate (7). FIG. 4B shows the placement and orientation of hinge (13) on the inside surface of support arm (32).

The hinge (13) rests in the slot (11) when the sequence is in its folded portable orientation. On the inside or top portion of base 30 is the hinge (26) that joins base 30 to support arm (32), allowing the swing training aid (10) to assume its upright position. The locking mechanism (6) is shown in FIG. 4A which illustrates the outside surface of support arm (32). Locking mechanism (6) can be a lock, clasp, coupler, or any other mechanical coupling device. Locking mechanism (6) can be comprised of two pieces: a first piece disposed on the end of support plate (7), and a corresponding mating piece disposed on support arm (32).

Figure 5:
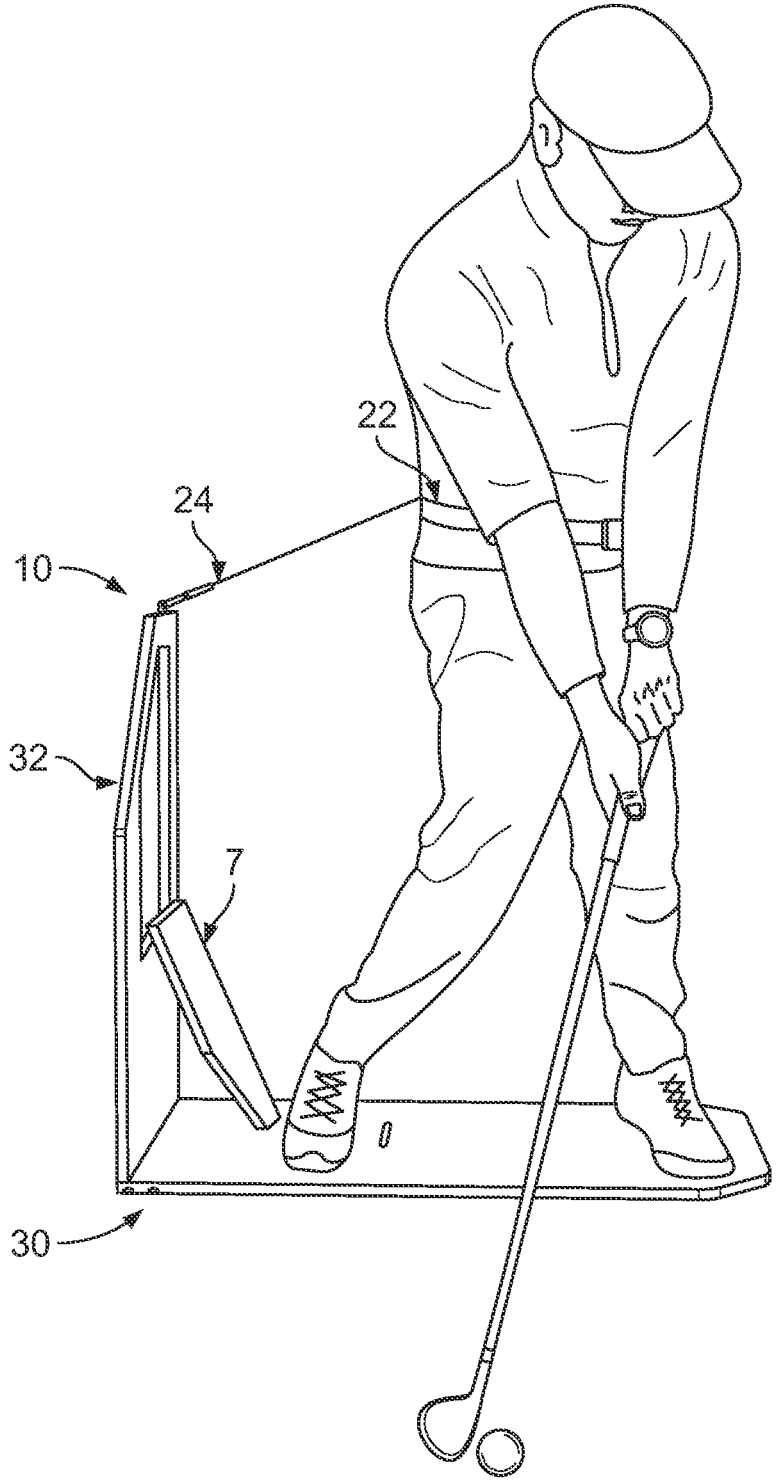
FIGS. 5-13 illustrate various uses of the swing training aid.

FIG. 5 shows use of the swing training aid (10), particularly illustrating assisted hip rotation impact position. The golfer uses resistive strap (24) attached on the anterior portion of the belt (22), then wrapped around the posterior aspect of the waistline prior to attaching the resistive band (24) to the anchor point (5) of support arm (32). The resulting force assists the hips in rotating towards the target.

Figure 6:
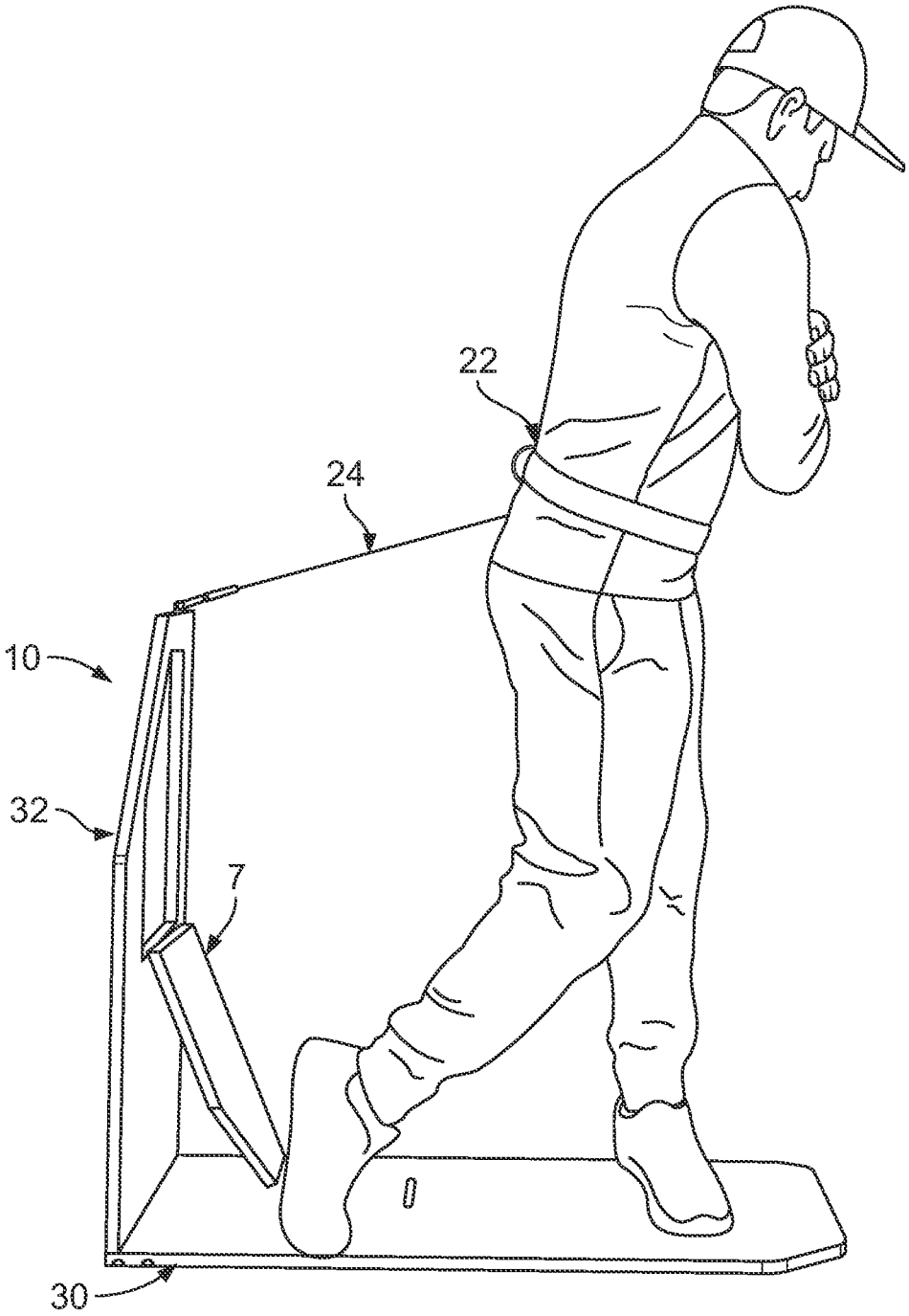

FIG. 6 shows assisted hip rotation. The golfer attaches the resistive band (24) to the anterior aspect of the belt (22) and wraps it around the posterior aspect of the waist prior to anchoring onto support arm (32). The lead leg is then placed in a neutral internal rotation (which can be assisted by the pegs (2) in the base (30) of the swing training aid (10)) position while the resistive band (24) assists with rotation towards the target line. This produces an internal rotation stretch on the lead leg.

Figure 7:
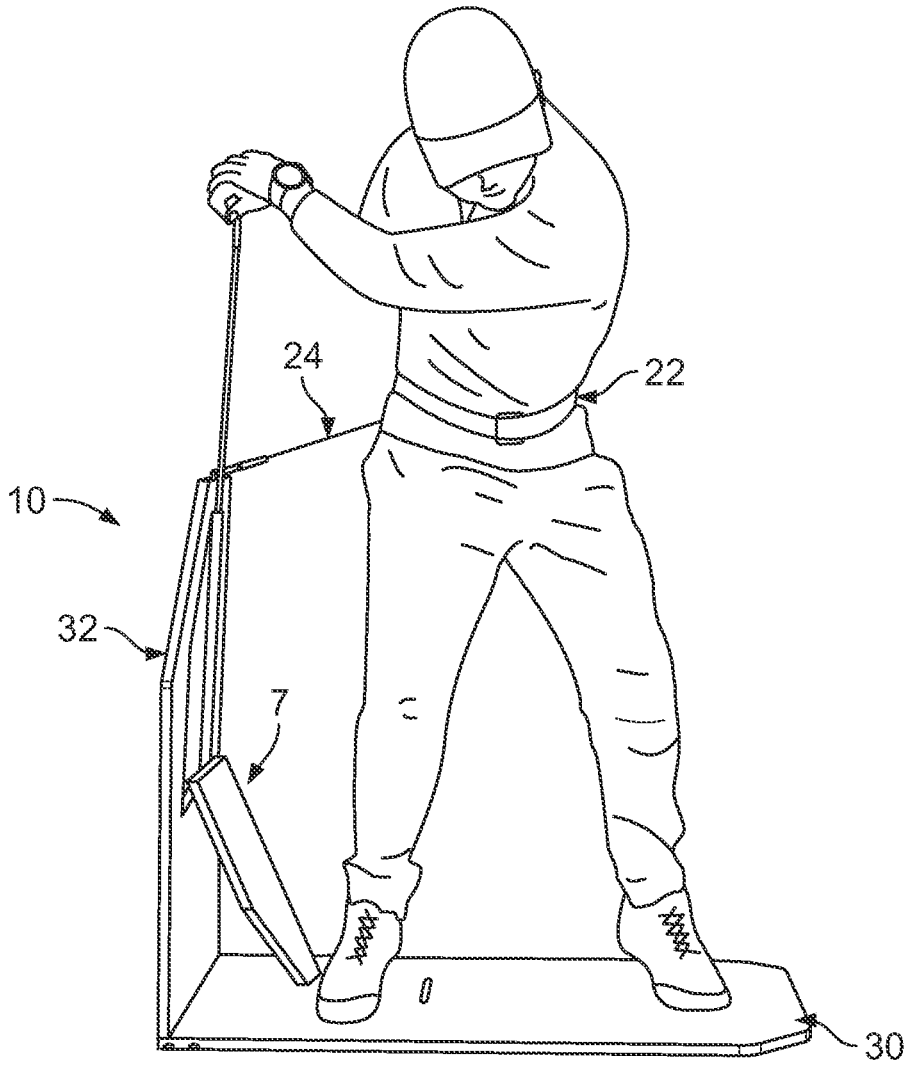

FIG. 7 shows assisted hip rotation latissimus stretch. For this, the golfer props a golf club on the support plate (7) of the support arm (32). The golfer then props his hands on top of the golf club while being assisted into hip rotation. The resultant force produces a stretch through the torso and into the latissimus dorsi to improve the dissociation of the upper body from the lower body in rotation.

Figure 8:
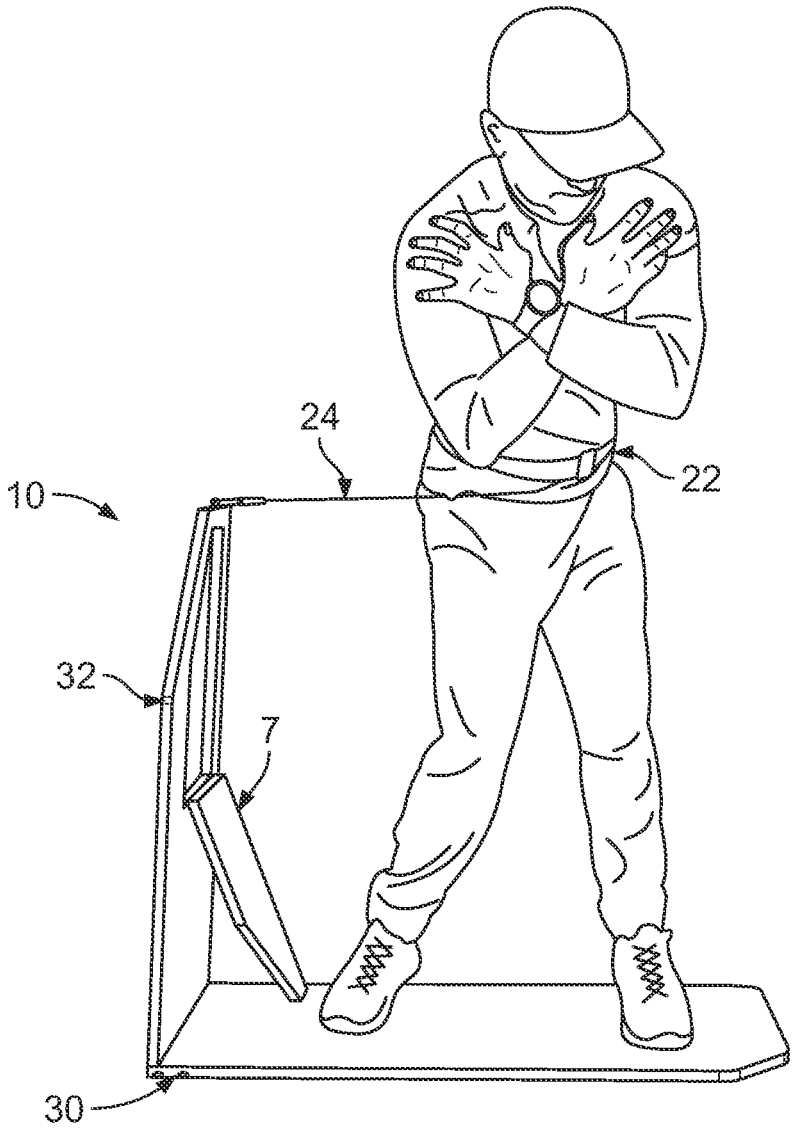

FIG. 8 shows resisted hip rotation. The resistive band (24) is attached on the posterior of the belt (22). The resistive band (24) is then wrapped around the anterior surface of the waistline of the user and anchored to the upright (support arm (32)). The golfer then works on producing hip rotation against resistance. This produces resistance in hip rotation toward the target to improve strength and timing.

Figure 9:
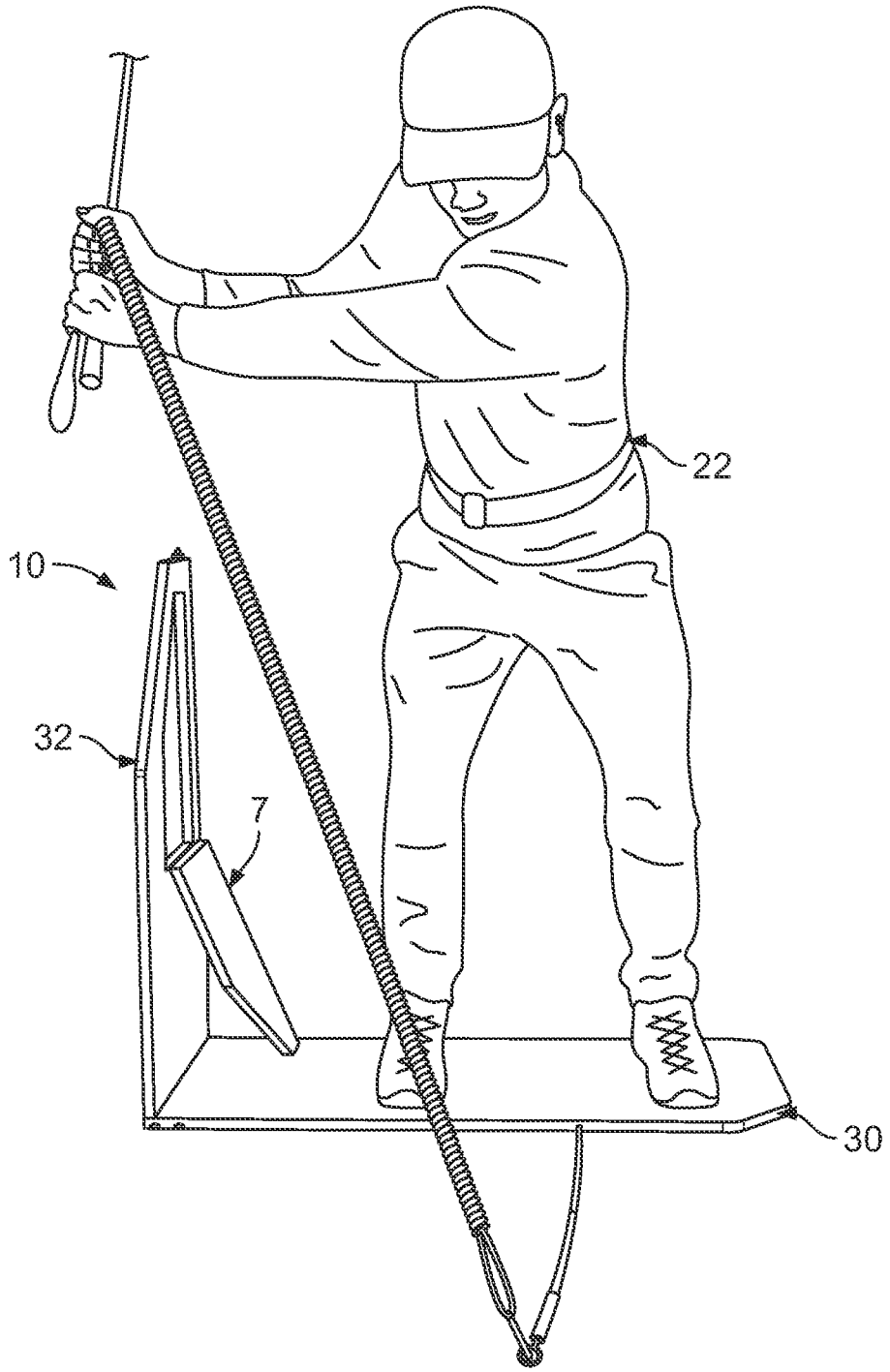

FIG. 9 shows use of the coil indicator (15). Particularly, the coil indicator (15) is placed such that the anchor point for the Coil indicator strap (17) is at the desired ball position for the golfer. There is enough slack in the coil indicator strap (17) such that when the lead arm is parallel, this produces a slight flex in the coil indicator rod (15).

Figure 10:
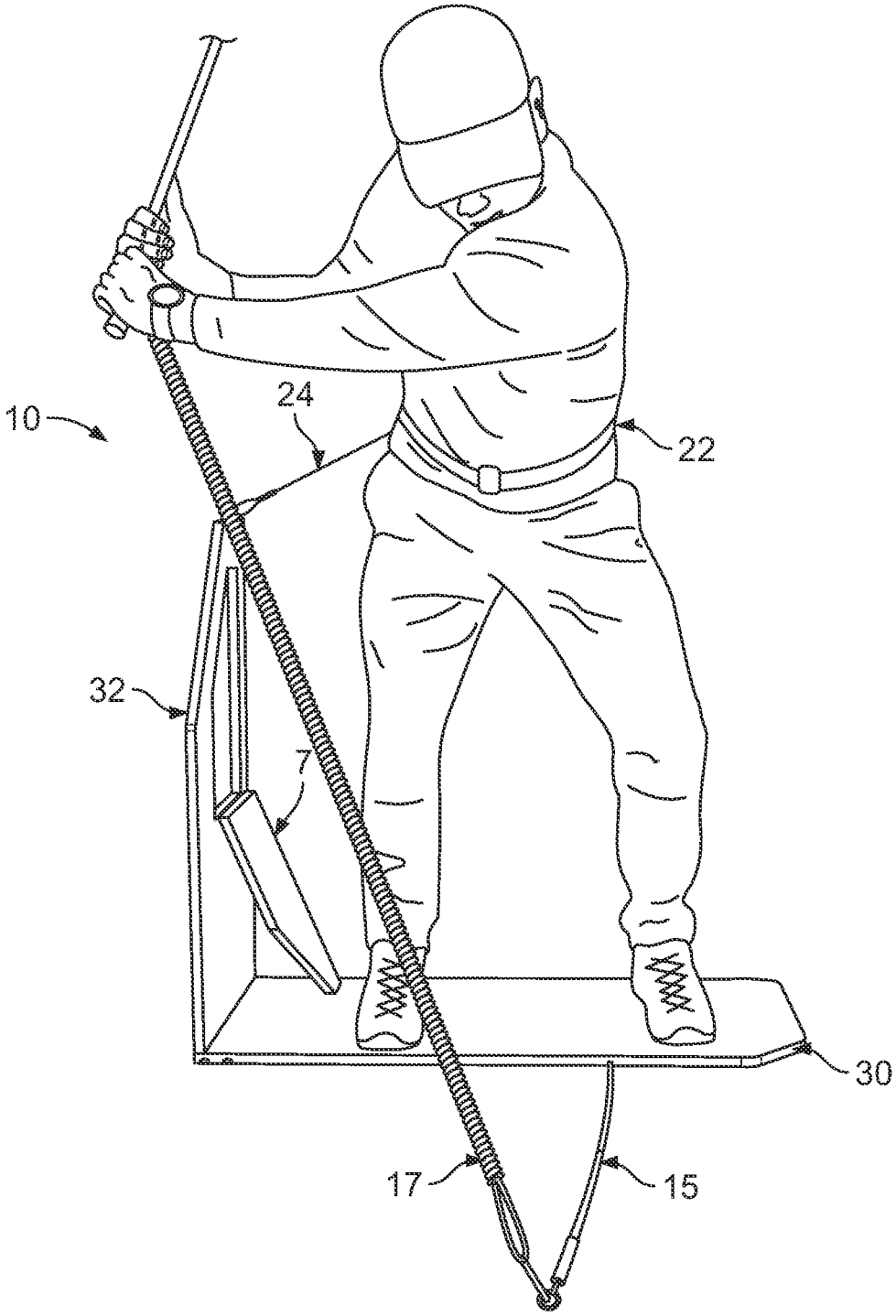

FIG. 10 shows the coil indicator (15) with assisted hip rotation. The coil indicator (15) is pulled until the lead arm is parallel. There should be sufficient slack in the coil indicator (15) such that this produces a slight flex in the coil indicator rod (15). The resistive band (24) is anchored on the anterior aspect of the belt (22) and wrapped around the posterior aspect of the waistline of the user. The resistive band (24) is then anchored to the upright to produce assistance in rotation of the hips towards the target line.

Figure 11:
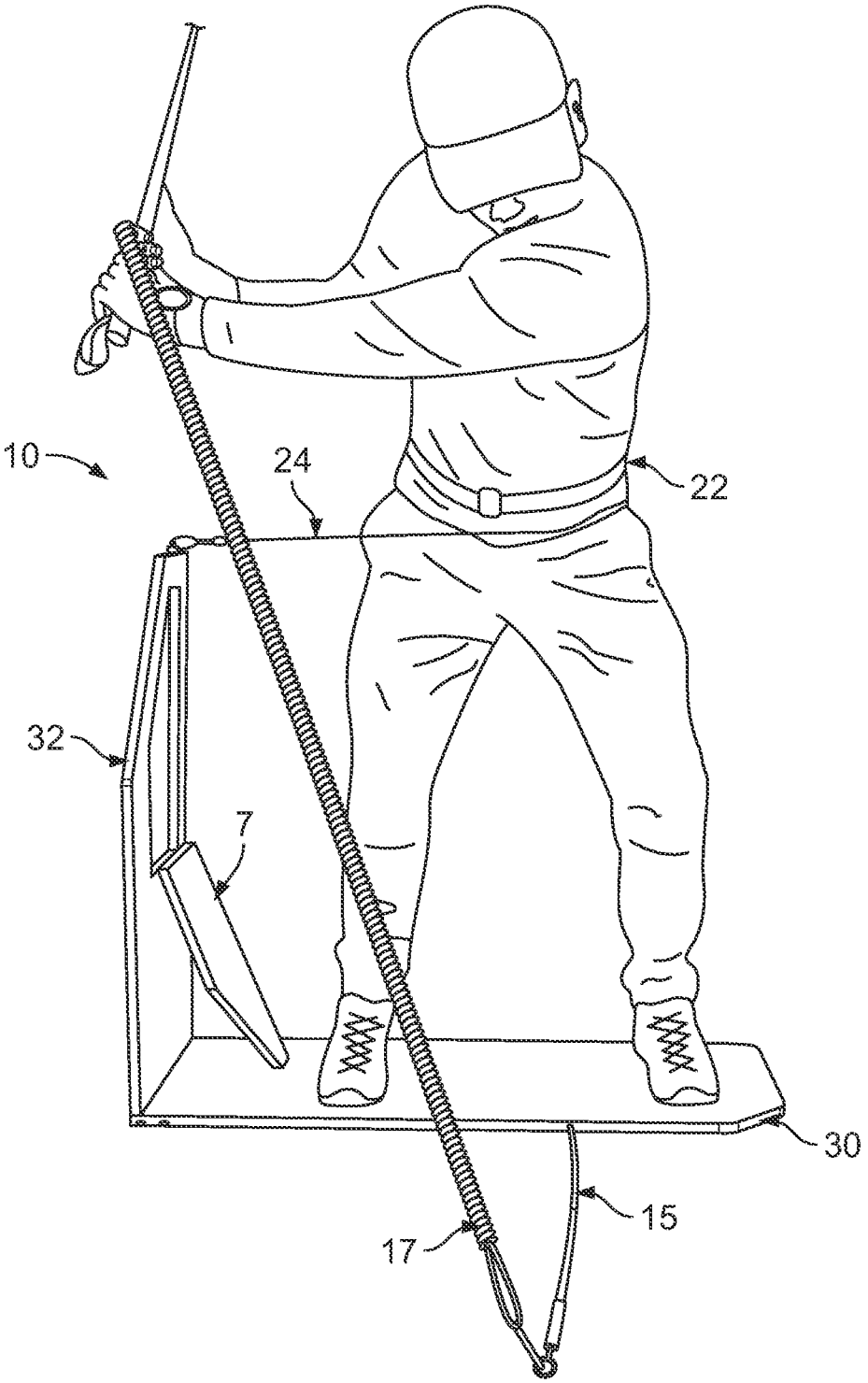

FIG. 11 shows the coil indicator (15) with resisted hip rotation. The coil indicator (15) is pulled up until the lead arm is parallel. There should be sufficient slack in the coil indicator strap (17) such that this produces a slight flex in the coil indicator rod (15). The resistive band (24) is anchored on the posterior aspect of the belt (22) and wrapped around the anterior aspect of the waist. The resistive band (24) is then anchored on to the support arm (32). The resulting force produces resistance in hip rotation towards the target line while coaching the golfer to hold the hand back and maintain relative rotation away from the target line. Because slots (9) are substantially perpendicular to the base length axis (BA) of the base (30), when *coli* indicator (15) is inserted into and coupled with one of the slots (9), coil indicator (15) is also substantially perpendicular to the base length axis (BA) in a neutral position when no outside forces are acting on coil indicator (15) to flex the coil indicator (15).

As seen in FIGS. 10 & 11, training device (10) provides different resistive forces to the user to aid the user in their swinging motion. A first resistive force is applied to the user due to belt (22) being coupled to support arm (32) via resistive band (24). As the user performs the swing motion, the resistive band (24) is in tension such that the first restive force is experienced against the wait/torso/trunk area of the user during certain parts, or the entirety, of the swinging motion. A second restive force is applied to the user due to the indicator strap (17) being coupled to base (30) via indicator coil rod (15). Indicator strap (17) is coupled to the athletic object being swung by the user and the indicator coil rod (15), which is coupled to base (30). As the user swings the athletic object, tension forms in the indicator strap (17) and the second resistive force is applied to the user as a result during a part of, or the entirety of, the swinging motion. In some embodiments, resistive band (24) and indicator strap (17) are formed of an elastic material, and the restive forces applied to the user are variable depending on the movements or position of the user during the swinging motion.

Figure 12:
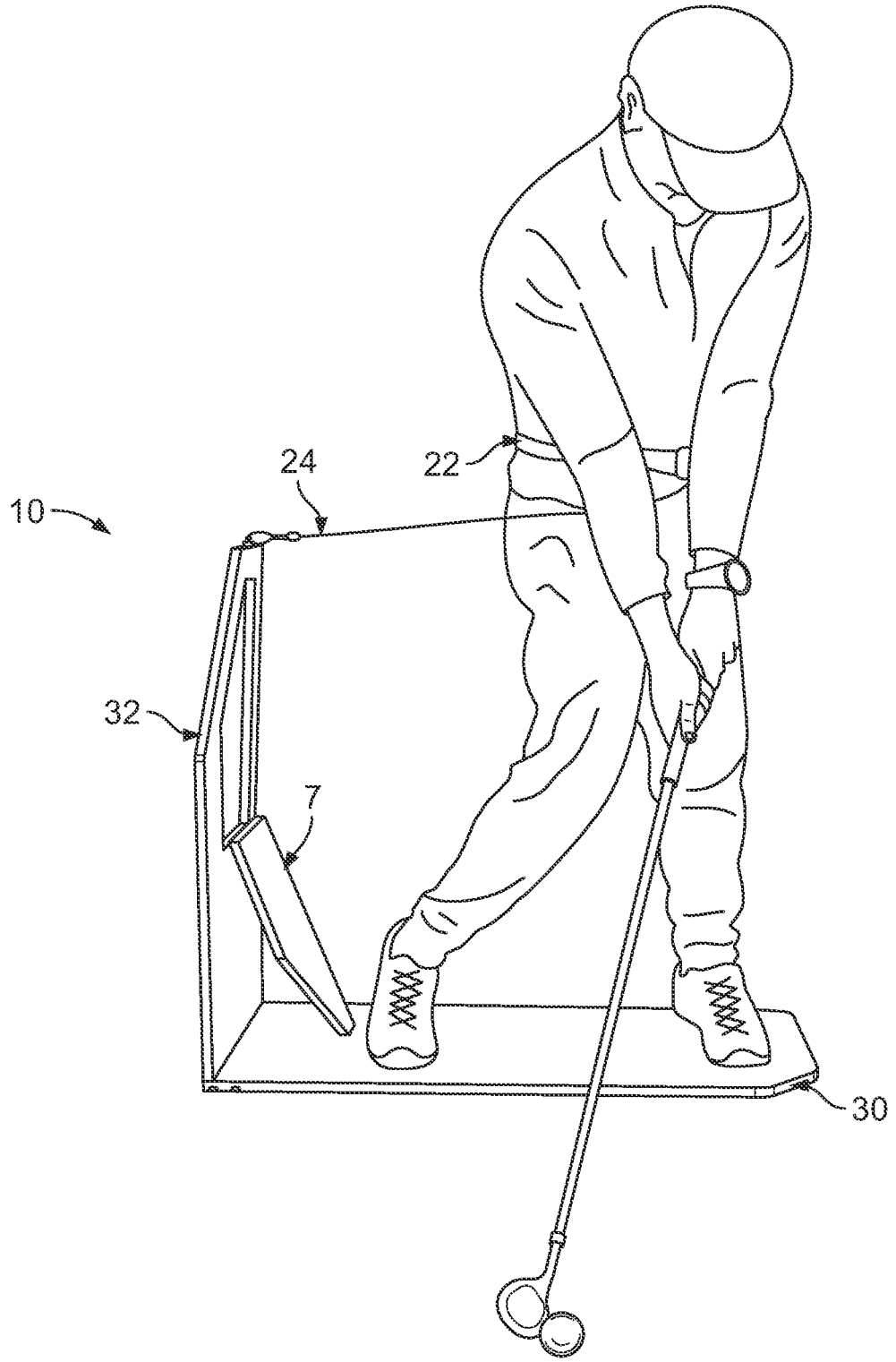

FIG. 12 shows hitting against resistive rotation. The golfer attaches the resistive band (24) to the posterior aspect of the belt (22) and then wraps the resistive band (24) around the anterior aspect of the waist prior to attaching it to the support arm (32). The golfer then practices hitting golf balls against resisted rotation of the hips towards the target line to improve strength. shows resisted hip rotation. The resistive band (24) is anchored on the posterior aspect of the belt (22) and wrapped around the anterior aspect of the waist prior to being attached to the support arm (32).

Figure 13:
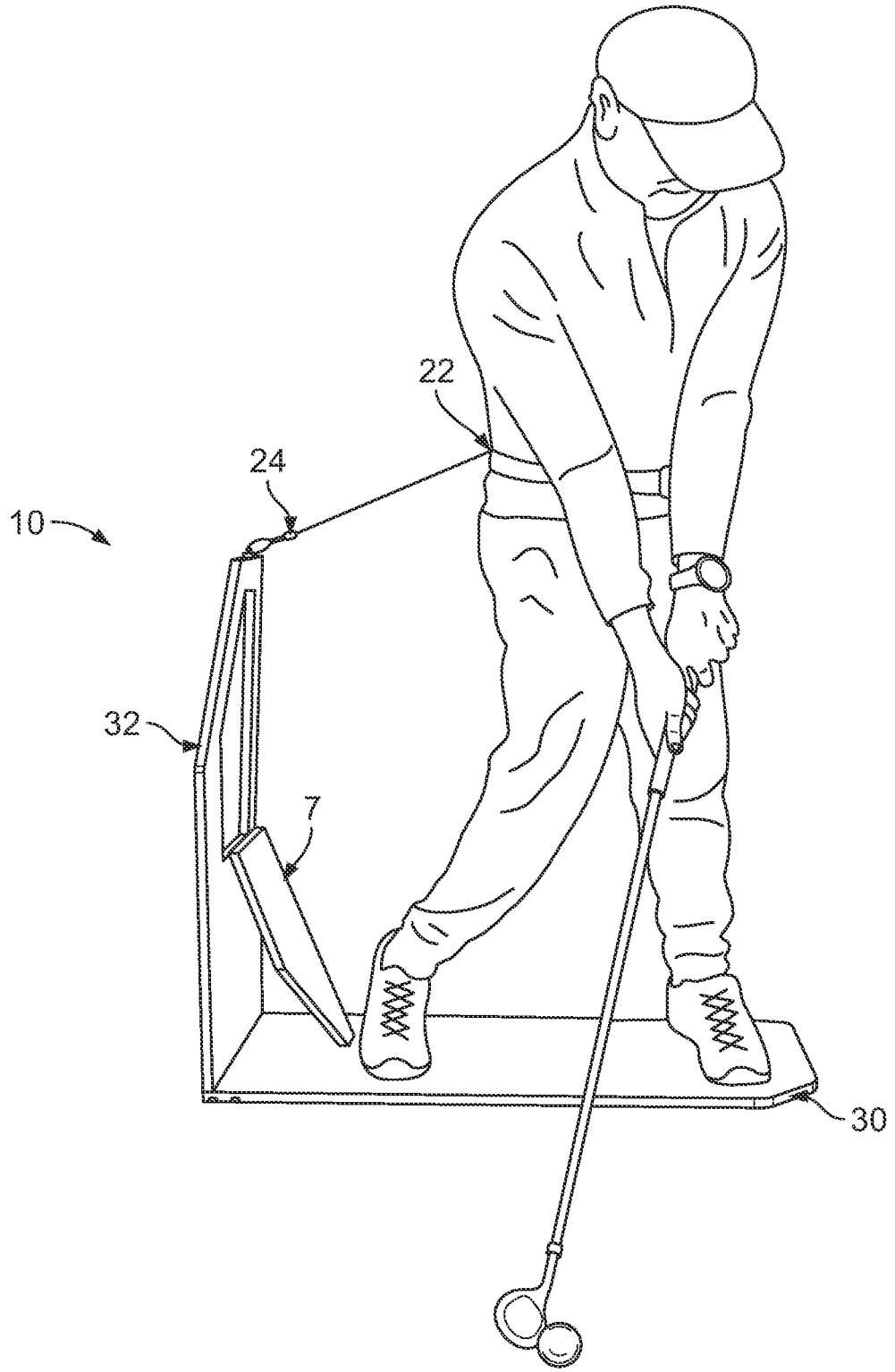

FIG. 13 shows hitting with assisted hip rotation. The golfer anchors the resistive band (24) on the anterior aspect of the belt (22) and wraps it around the posterior aspect of the waist prior to anchoring to the support arm (32). The golfer then practices hitting while the resistive band (24) assists in producing hip rotation towards the target line.

Other Alternatives

Although the present invention has been described in terms of the foregoing disclosed embodiments, this description has been provided by way of explanation only and is not intended to be construed as a limitation of the invention. Indeed, even though the foregoing descriptions refer to numerous components and other embodiments that are presently contemplated, those of ordinary skill in the art will recognize many possible alternatives that have not been expressly referenced or even suggested here. While the foregoing written descriptions should enable one of ordinary skill in the pertinent arts to make and use what are presently considered the best modes of the invention, those of ordinary skill will also understand and appreciate the existence of numerous variations, combinations, and equivalents of the various aspects of the specific embodiments, methods, and examples referenced herein.

Hence the drawings and detailed descriptions herein should be considered illustrative, not exhaustive. They do not limit the invention to the particular forms and examples disclosed. To the contrary, the invention includes many further modifications, changes, rearrangements, substitutions, alternatives, design choices, and embodiments apparent to those of ordinary skill in the art, without departing from the spirit and scope of this invention.

Accordingly, in all respects, it should be understood that the drawings and detailed descriptions herein are to be regarded in an illustrative rather than a restrictive manner, and are not intended to limit the invention to the particular forms and examples disclosed. In any case, all substantially equivalent systems, articles, and methods should be considered within the scope of the invention and, absent express indication otherwise, all structural or functional equivalents are anticipated to remain within the spirit and scope of the presently disclosed systems and methods.

What is claimed is:

1. A training device for aiding a user in performing a swing motion of an athletic object, the training device comprising:

a base including a top surface upon which the user is configured to stand when using the training device and a bottom surface, opposite the top surface, and configured to contact the ground when the training device is being used by the user;

a support arm hingedly connected with the base such that the support arm can be disposed in a closed position in which the support arm contacts the top surface of the base and an open position in which the support arm and the top surface of the base are separated, the support arm including:

a support plate hingedly connected with the support arm and including a lock configured to be coupled with the support arm, wherein:

when the support arm is in the closed position, the support plate is configured to be coupled to the support arm via the lock, and when the support arm is in the open position, the support plate is configured to rotate about its hinged connection with the support arm such that the support plate is inserted into a support slot disposed on the top surface of the base to support the open position of the support arm;

a belt configured to be worn by the user when using the training device;

a resistance band configured to be coupled with a ring of the belt and with an anchor disposed on the support arm when the support arm is in the open position;

an indicator rod configured to be coupled with one of a plurality of rod slots disposed on the bottom surface of the base, each of the plurality of rod slots having a length axis substantially perpendicular to a length axis of the base such that the indicator rod is substantially perpendicular with the length axis of the base when the indicator rod is coupled with one of the plurality rod slots; and a coil indicator strap configured to be coupled with an anchor point of the indicator rod and having a receiver loop configured to receive the athletic object being swung by the user, wherein when the user uses the training device to perform the swing motion of the athletic object, the training device is configured to apply to the user:

a first resistive force by the resistance band and the belt coupled to the support arm, and a second resistive force by the coil indicator strap and the indicator rod coupled to the base.

2. A training device as in claim 1, wherein said belt further comprises non-slip material disposed on an interior surface of the belt and configured to prevent the belt from slipping from the user when in use.

3. A training device as in claim 1, wherein:

said coil indicator strap comprises an elastic material;

said coil indicator strap is coupled with an anchor point;

one end of said coil indicator strap attaches to the anchor point on said indicator rod, the other end of said coiled indicator strap is a receiver loop held in the hands of the user alongside the athletic object; and said coil indicator strap aids a user in improving the accuracy and arc in performing a swing motion of an athletic object.

4. A training device as in claim 3, wherein said indicator rod comprises:

a cylindrical rod, a first end of which has an anchor point while the other, second end of said cylindrical rod has an open-ended anchor point to attach the coiled indicator to.

5. A training device as in claim 4, wherein the first end of said indicator rod is configured to fit within one of a plurality of slots within the bottom surface of said base in an orientation that positions said indicator rod to perpendicularly extended from an edge of said base, the second end of said indicator rod being exposed such that the open-ended anchor point can be to be attached to the coiled indicator strap.

6. A training device as in claim 5, wherein said indicator rod has the ability to flex while resisting when force is applied, with the purpose of guiding the user's swing back to a specific point at the swing implement receiver loop.

7. A training device for aiding a user in performing a swing motion of an athletic object, the training device comprising:

a generally planar base having a top surface and a bottom surface, opposite the top surface, wherein said base is configured such that its bottom surface is able to contact and rest on the ground when the training device is being used by a user, and wherein said base is configured for a user to stand on the top surface thereof when using the training device;

a support arm with a proximal end and a distal end, wherein the proximal end of said support arm is movably connected to the base, and wherein the distal end of said support arm is movable into an operative position wherein the distal end is positioned above the plane of said base;

a support plate for holding the support arm in its operative position, said support plate having an upper edge and a lower edge, the lower edge being opposite the upper edge, the upper edge being connected to the support arm at a height between the proximal end and the distal end of said support arm, and the lower edge being removably engageable with an opening on the upper surface of said base;

a belt configured to be worn by the user when using the training device; and a resistance band configured to be coupled with a ring of the belt and with an anchor disposed on or near the distal end of the support arm when the support arm is in its operative position.

8. A training device as in claim 7 wherein said support arm comprises a generally planar member, and said support arm can be disposed in its operative position or in a stowed position, wherein the plane of said support arm is generally parallel and adjacent to the plane of the base member when said support arm is disposed in said stowed position.

9. A training device as in claim 7 wherein said support plate comprises a generally planar member having a shape and size smaller than the shape and size of said support arm, and said support plate can be disposed in its operative position is at an angle between the base and support arm in which the support plate is inserted into a support slot disposed within the top surface of the base, or in a stowed position in which the plane of said support plate is generally parallel and adjacent to the plane of the base member and the plane of said support arm when said support plate is disposed in said stowed position.

10. A training device as in claim 7, wherein said support arm has a cavity with a shape matching that of said support plate, wherein said support plate hingedly fits into said cavity when being disposed in the stowed position.

11. A training device as in claim 7, wherein the upper edge of said support plate is fastened into the stowed position within the said cavity of the support arm by means of a mechanical coupling device, wherein there are two pieces, one on the upper edge of said support plate, and a corresponding piece near the distal end of the support arm.

12. A training device as in claim 7, wherein the support arm when in its operative position is generally perpendicular to the planar base, and the upper end of said support plate fits and is engaged within a slot within the top surface of said base to prevent the support arm from moving during use of the device.

13. A training device as in claim 7, wherein the proximal end of said support arm is hingedly connected to the base, such that the support arm can be opened to a position in which said support arm generally perpendicular with said base.

14. A training device as in claim 7, wherein the top surface of said base has a plurality of openings puncturing through the depth of the board such that a user can place golf tees into the openings to help guide the position of the user's feet.

15. A training device as in claim 7, wherein said belt has an outside surface and an inside surface, opposite the outside surface, wherein said belt is adjustable when worn by a user by means of a D ring belt buckle.

16. A training device as in claim 15, wherein:

the outside surface of said belt comprises a bidirectional anchor point in the center of the belt;

said bidirectional anchor point can be attached to another anchor point.

17. A training device as in claim 16, wherein said resistance band comprises:

a thin band with two anchor points on either end of the band, wherein one of said anchor points attaches to said bidirectional anchor point of said belt, and the other of said anchor points attaches to an anchor point on the distal end of said support arm.

18. A training device as in claim 17, wherein said resistance band when attached to an anchor point is capable of imposing an opposing force against or an assist force to the user's waist during rotary movement of the waist.

19. A training device as in claim 15, wherein the inside surface of said belt comprises nonslip strips to prevent the belt from sliding while being used.

20. A training device for aiding a user in performing a swing motion of a golf club, the training device comprising:

A planar base having a top surface upon which the user is able to stand when comprising the training device when the training device is in a deployed position, said top surface having openings puncturing through its depth in a distal end of said base such that a user can insert golf tees in said openings, and said top surface having a slot near a proximal end of said base;

said base further having a bottom surface, opposite the top surface, through which the base is able to make contact and rest on the ground, said bottom surface having a plurality of slots sized for receiving part of the length of an indicator rod;

a support arm hingedly connected to the proximal end of said base such that the support arm can be disposed in a stowed position or a deployed position, said support arm being generally parallel and adjacent to the plane of said base when said support arm is in its stowed position, and said support arm being generally perpendicular to the plane of said base when said support arm is in its deployed position;

said support arm having a cavity;

a support plate having a proximal edge hingedly connected with said support arm such that said support plate can be disposed in a stowed position within said cavity of said support arm and can be retained in that stowed position by means of a mechanical coupling device;

said support plate further having a distal edge sized and shaped to fit within said slot of the top surface of said base when said support arm is in its deployed position;

a belt configured to be worn by the user while using the training device, said belt being adjustable by means of a belt buckle, said belt having an outside surface comprising a bidirectional anchor point in the center of said belt, and said belt having an inside surface that comprises nonslip strips to prevent the belt from sliding while in use;

a resistance band comprising a first anchor point on one end of said resistance band and a second anchor point on the other end of said resistance band, wherein the first anchor point of said resistance band is coupled with the anchor point of said belt;

wherein the second anchor point of said resistance band can be attached to a distal end of said support arm when said support arm is deployed in its operative position;

wherein said resistance band, when its first anchor point is attached to the anchor point of said belt and its second anchor point is attached to the distal end of said support arm, is capable of assisting the user's rotary movement of the waist by placing an opposing force against the user;

a coil indicator strap comprising an elastic material, said coil indicator strap having an anchor point on an end of the strap that is capable of coupling with the open-ended anchor point of an indicator rod, and said coil indicator strap having a receiver loop configured to receive a golf club swung by the user, said coil indicator strap being intended to aid a user in improving the accuracy and arc while performing a swing motion of the golf club; and an indicator rod comprising a cylindrical rod with part of its length sized to fit in one said plurality of slots in the bottom surface of said base, a first end of said indicator rod having an anchor point while a second, opposite end of said indicator rod has an open-ended anchor point exposed to be attached to the anchor point of said coil indicator strap, wherein the anchor point of the first end of said indicator rod is capable of anchoring within one of the plurality of slots within the bottom surface of said base in a manner that exposes the open-ended anchor point at the opposite end of said indicator rod to be attached to the coil indicator strap, and wherein said indicator rod is capable of flexing slightly to resist force when a user applies force against it.

* * * * *